US011988445B2

(12) United States Patent
Kennedy et al.

(10) Patent No.: US 11,988,445 B2
(45) Date of Patent: May 21, 2024

(54) PREPARING HYDROCARBON STREAMS FOR STORAGE

(71) Applicant: GE Oil & Gas, Inc., Houston, TX (US)

(72) Inventors: David Allen Kennedy, New Braunfels, TX (US); Mark Mulherin Salamon, Schertz, TX (US); Christopher Scott Yount, San Antonio, TX (US)

(73) Assignee: GE Oil & Gas, Inc., Houston, TX (US)

( * ) Notice: Subject to any disclaimer, the term of this patent is extended or adjusted under 35 U.S.C. 154(b) by 171 days.

(21) Appl. No.: 17/178,613

(22) Filed: Feb. 18, 2021

(65) Prior Publication Data

US 2021/0172676 A1 Jun. 10, 2021

Related U.S. Application Data

(62) Division of application No. 14/974,602, filed on Dec. 18, 2015, now Pat. No. 10,928,128.

(60) Provisional application No. 62/156,664, filed on May 4, 2015.

(51) Int. Cl.
*F25J 3/02* (2006.01)
*F25J 3/08* (2006.01)

(52) U.S. Cl.
CPC ..... *F25J 3/0214* (2013.01); *F25J 3/0219* (2013.01); *F25J 3/0233* (2013.01); *F25J 3/0238* (2013.01); *F25J 3/08* (2013.01); *F25J 2200/74* (2013.01); *F25J 2205/04* (2013.01); *F25J 2215/04* (2013.01); *F25J 2215/62* (2013.01); *F25J 2240/40* (2013.01); *F25J 2245/02* (2013.01);

(Continued)

(58) Field of Classification Search
CPC ..... F25J 3/0233; F25J 3/0238; F25J 2200/74; F25J 2205/10; F25J 2215/04; F25J 3/08; F25J 3/0214; F25J 3/0219; F25J 2270/60; F25J 2215/62; F25J 2245/02; F25J 2245/90
See application file for complete search history.

(56) References Cited

U.S. PATENT DOCUMENTS 3,319,429 A * 5/1967 Pryor ..... F25J 3/0261 62/622
3,675,435 A * 7/1972 Jackson ..... C07C 7/09 62/622

(Continued)

FOREIGN PATENT DOCUMENTS

CN 1043731 A 7/1997
CN 101283078 A 10/2008

(Continued)

*Primary Examiner* — John F Pettitt, III
*Assistant Examiner* — Webeshet Mengesha
(74) *Attorney, Agent, or Firm* — Paul Frank + Collins P.C.

(57) ABSTRACT

A system and process that are configured to prepare incoming hydrocarbon feedstocks for storage. For incoming ethane gas, the embodiments can utilize a plurality of vessels to distill the incoming feedstock to vapor and liquid ethane that is suitable for storage. The embodiments can direct the vapor to a demethanizer column that is downstream of the vessels and other components. The process can include stages for distilling an incoming feedstock at a plurality of vessels to form a vapor and a liquid for storage; directing the vapor to a demethanizer column; and circulating liquid from the demethanizer column back to the plurality of vessels.

3 Claims, 6 Drawing Sheets

FIG. 2

(52) U.S. Cl.
CPC ..... *F25J 2245/90* (2013.01); *F25J 2270/12* (2013.01); *F25J 2270/60* (2013.01)

(56) References Cited

U.S. PATENT DOCUMENTS

| | | | | |
|---|---|---|---|---|
| 4,155,729 | A * | 5/1979 | Gray | F25J 3/0209 62/621 |
| 4,225,329 | A * | 9/1980 | Bailey | F25J 3/0257 62/623 |
| 4,507,133 | A * | 3/1985 | Khan | C07C 7/09 62/621 |
| 6,105,391 | A * | 8/2000 | Capron | F25J 3/0257 62/910 |
| 6,662,589 | B1 * | 12/2003 | Roberts | F25J 3/0242 62/425 |
| 6,915,662 | B2 | 7/2005 | Wilkinson et al. | |
| 7,484,385 | B2 | 2/2009 | Patel et al. | |
| 7,713,497 | B2 | 5/2010 | Mak | |
| 8,707,730 | B2 | 4/2014 | Prim | |
| 2010/0223950 | A1 * | 9/2010 | Malsam | F25J 3/0238 62/611 |
| 2015/0226089 | A1 | 8/2015 | Roy et al. | |

FOREIGN PATENT DOCUMENTS

| | | | |
|---|---|---|---|
| CN | 101539364 | A | 9/2009 |
| CN | 10358188 | A | 4/2013 |
| CN | 103542693 | A | 1/2014 |
| CN | 103776238 | A | 5/2014 |
| CN | 103822438 | A | 5/2014 |
| CN | 204298357 | U | 4/2015 |
| CN | 204310982 | U | 5/2015 |
| CN | 204757540 | U | 11/2015 |
| CN | 203837412 | U | 9/2017 |
| DE | 102011108487 | A1 | 1/2013 |
| GB | 857587 | | 1/1961 |
| WO | 2014006178 | A1 | 1/2014 |
| WO | 2015105603 | A1 | 7/2015 |

* cited by examiner

PREPARING HYDROCARBON STREAMS FOR STORAGE

CROSS-REFERENCE TO RELATED APPLICATIONS

This application is a divisional of U.S. Ser. No. 14/974,602, filed on Dec. 18, 2015, and entitled "PREPARING HYDROCARBON STREAMS FOR STORAGE," which claims priority to U.S. Provisional Application Ser. No. 62/156,664, filed on May 4, 2015, and entitled "PROCESSING AND STORING A FEEDSTREAM AT ATMOSPHERIC PRESSURE." The content of these applications is incorporated by reference in its entirety herein.

BACKGROUND

Liquefying hydrocarbon gas can facilitate transport and storage of hydrocarbons and related material. Generally, the processes greatly reduce the volume of gas. The resulting liquid is well-suited to transit long distance through pipelines and related infrastructure. For pipeline transportation, it may be most economical to transport hydrocarbon liquid at ambient temperature and high pressure because it is easier to address requirements for wall thickness of the pipe without the need to insulate the entire length of the pipeline. For storage, it may be better for hydrocarbon liquid to be at or near atmospheric pressure to economically resolve the insulation and wall thickness requirements.

SUMMARY

The subject matter of this disclosure relates generally to hydrocarbon processing. The embodiments may form a fluid circuit that incorporates components to prepare an incoming liquid ethane stream for storage. These components can include a distilling unit embodied as a plurality of vessels to separate the incoming liquid ethane stream into a liquid for storage. The fluid circuit can also include a demethanizer column that is in position downstream of the vessels.

Some embodiments configure the vessels to permit a position for the demethanizer column in the back or "tail" end of the fluid circuit. The vessels can reduce the amount of flash gas processed by the demethanizer column. In turn, compression requirements are lower in order maintain pressure of the flash gas and boil-off gas that the embodiments combine together for processing at the demethanizer column. This boil-off gas can originate from storage of the final, liquid ethane product. In this way, horsepower requirements for the embodiments will compare favorably to other processes that may utilize, for example, one or more demethanizer columns at the "front" end of the fluid circuit.

Some embodiments may be configured to process a propane stream. This stream can also transit a pipeline to a processing facility that is adjacent to embodiments of the processing system. Temperatures may be warmer for propane, thus reducing refrigeration requirements and, possibly eliminating a refrigeration circuit alltogether. In one implementation, the components may use a deethanizer in lieu of the demethanizer column. The lighter hydrocarbons would be methane. Propane can be stored at ambient temperature and pressure of 208 psig.

The embodiments can also be configured to recover other hydrocarbons from the incoming ethane stream. These other hydrocarbons are particularly useful as fuel gas and/or as raw materials for use in various petrochemical applications. In this way, the embodiments may avoid unnecessary loss of products from the feed stream, effectively adding value and/or optimizing profitability of the liquefaction process.

The embodiments may find use in many different types of processing facilities. These facilities may be found onshore and/or offshore. In one application, the embodiments can incorporate into and/or as part of processing facilities that reside on land, typically on (or near) shore. These processing facilities can process the feedstock from production facilitates found both onshore and offshore. Offshore production facilitates use pipelines to transport feedstock extracted from gas fields and/or gas-laden oil-rich fields, often from deep sea wells, to the processing facilitates. For liquefying processes, the processing facility can turn the feedstock to liquid using suitably configured refrigeration equipment or "trains." In other applications, the embodiments can incorporate into production facilities on board a ship (or like floating vessel).

BRIEF DESCRIPTION OF THE DRAWINGS

Reference is now made briefly to the accompanying drawings, in which.

Figure 1:
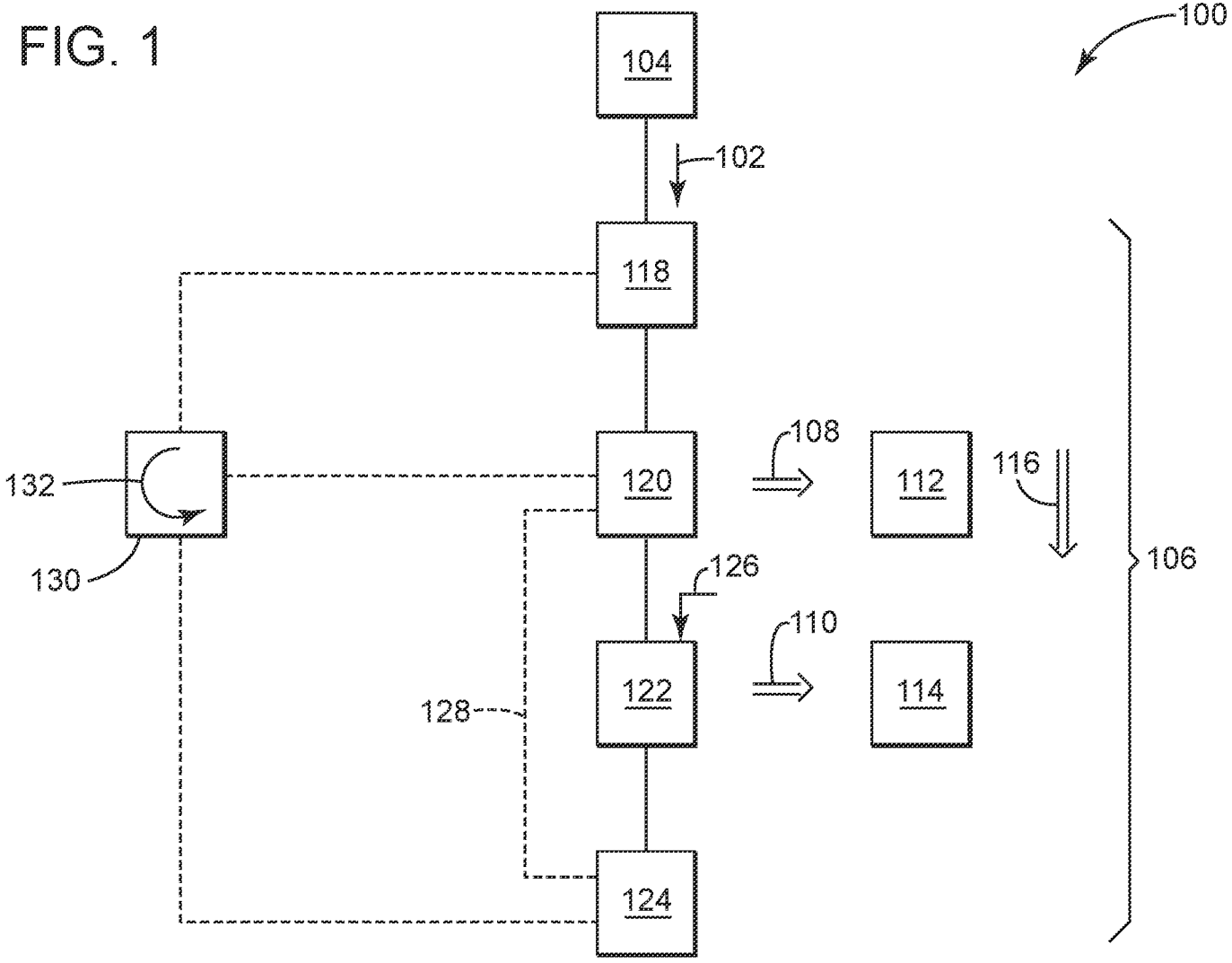
FIG. 1 depicts a schematic diagram of an exemplary embodiment of a processing system with a fluid circuit that is useful to prepare incoming hydrocarbon feedstock for storage.

Where applicable like reference characters designate identical or corresponding components and units throughout the several views, which are not to scale unless otherwise indicated. The embodiments disclosed herein may include elements that appear in one or more of the several views or in combinations of the several views. Moreover, methods are exemplary only and may be modified by, for example, reordering, adding, removing, and/or altering the individual stages.

DETAILED DESCRIPTION

The discussion below contemplates embodiments that are useful to process liquid hydrocarbons for storage. The embodiments herein feature improvements that can reduce the overall size and, in turn, the overall investment necessary for commercial processing of ethane and other hydrocarbon streams. Large operations that process quantities of liquid ethane in excess of 120,000 barrels per day may benefit in particular because the embodiments can use components that are substantially smaller than similar components, even when such similar components are "split" to more easily fabricate and ship to the installation site or facility. Other embodiments are contemplated with the scope of the disclosed subject matter.

FIG. 1 illustrates a schematic diagram of an exemplary embodiment of a processing system 100 (also "system 100") for use to process hydrocarbon streams. The system 100 can receive a feedstock 102 from a source 104. The feedstock 102 can comprise liquid with a composition that is predominantly ethane, although the system 100 may be useful for other compositions as well. In one implementation, incoming feedstock 102 may comprise ethane liquid with a first concentration of methane of approximately 3% or less. The system 100 can have a fluid circuit 106 to process incoming feedstock 102 to form one or more products (e.g., a first product 108 and a second product 110). The products 108, 110 can exit the system 100 to a storage facility 112, a pipeline 114, and/or other collateral process equipment. In operation, the fluid circuit 106 is configured so that the first product 108 meet specifications for storage, e.g., at the storage facility 112. These specifications may require a second concentration of methane that is lower than the first concentration of incoming feedstock 102. In one example, the second concentration of methane in the first product 108 for may be approximately 1% or less.

The fluid circuit 106 can circulate fluids (e.g., gases and liquids). For clarity, these fluids are identified and discussed in connection with operations of the embodiments herein as a process stream 116. At a high level, the embodiments may include a pre-cooling unit 118, a distilling unit 120, a mixing unit 122, and a demethanizer unit 124. In one implementation, the fluid circuit 106 can receive a return stream 126 that may originate from the storage facility 112, although this disclosure is not limited only to that configuration. The fluid circuit 106 can also be configured to separately couple the separator unit 120 and the demethanizer unit 124, as shown by the phantom line enumerated by the numeral 128. This configuration mixes outlet products from each of the units 120, 124 together to form the first product 108. As also shown in FIG. 1, the fluid circuit 106 may couple with certain collateral equipment, namely, a refrigeration unit 130 that couples with the fluid circuit 106. Examples of the refrigeration unit 130 may circulate a refrigerant 132 to coolers and/or like devices that condition temperature of the process stream 116 at one or more of the units 118, 120, 122, 124.

Broadly, use of the distilling unit 120 permits the demethanizer unit 124 to be located at the end of the fluid circuit 106. This position reduces the volume of incoming feedstock 102 that the demethanizer unit 124 processes during operation of the system 100. Some embodiments only require the demethanizer unit 124 to process approximately 20% of incoming feedstock 102, with the distilling unit 120 (and or other units in the fluid circuit 106) configured to process approximately 80% of incoming feedstock 102. In such embodiments, the demethanizer unit 124 receives and processes predominantly "flashed" gas (also, "vapor") that results from one or more of the other units 118, 120, 122. This feature is useful to reduce costs of the system 100 because the size of the demethanizer unit 124 is much smaller when at the "tail" end of the system 100 than in other positions further upstream in the fluid circuit 106. In one implementation, the demethanizer unit 124 has a diameter that is nine (9) feet or less.

Figure 2:
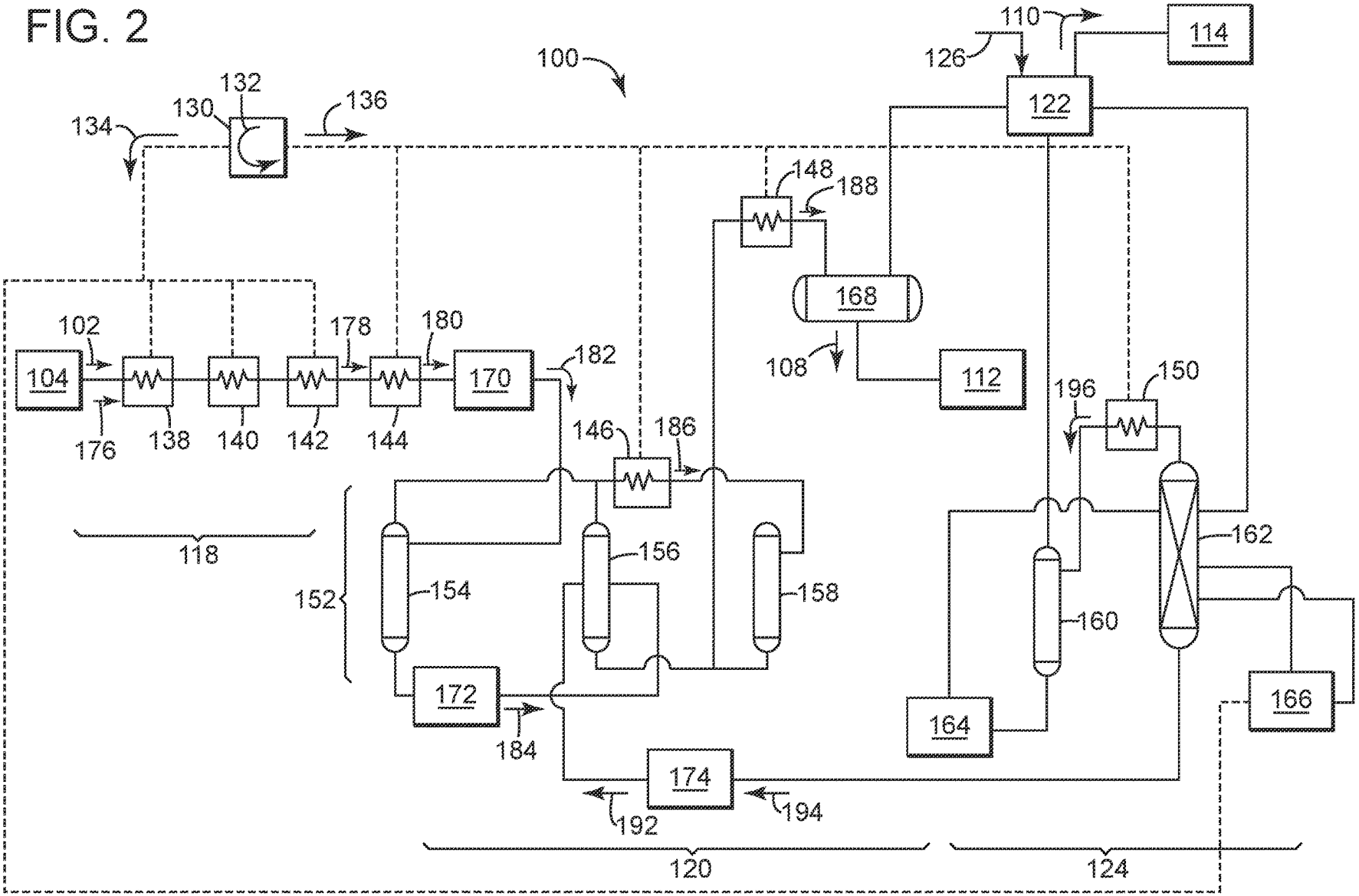
FIG. 2 depicts an example of the fluid circuit for use in the processing system of FIG. 1.

FIG. 2 illustrates an example of components to implement the processing system 100 to achieve the second concentration of methane in the first product 108. The refrigeration unit 130 can be configured to disperse the refrigerant 132 as a first refrigerant 134 and a second refrigerant 136. The refrigerants 134, 136 can facilitate thermal transfer at coolers disposed throughout the fluid circuit 106. In turn, the coolers can be configured to implement cooling in stages (also, "cooling stages") to reduce temperature of the process stream 116. Compositions for the refrigerants 134, 136 can include propylene and ethylene, respectively; however, other compositions may also pose as workable solutions to affect thermal transfer in the coolers. In the pre-cooling unit 118, the first refrigerant 134 can circulate across one or more coolers (e.g., a first cooler 138, a second cooler 140, and a third cooler 142). The second refrigerant 136 can regulate temperature at coolers at each of the separation unit 120 and the demethanizer unit 124. For the present implementation, the units 120, 124 can be configured to include one or more coolers (e.g., a fourth cooler 144, a fifth cooler 146, and a sixth cooler 148, a seventh cooler 150).

At the distilling unit 120, the fluid circuit 106 may include a separator 152 to form vapor, liquid, and mixed phase products. The separator 152 can generally be configured as a plurality of vessels (e.g., a first vessel 154, a second vessel 156, and a third vessel 158). The fluid circuit 106 may also include a fourth vessel 160 that couples with a demethanizer column 162 at the demethanizer unit 124. For operation, the components 160, 162 may benefit from use of one or more peripheral components (e.g., a first peripheral component 164 and a second peripheral component 166). Examples of these peripheral components 164, 166 can include pumps, boilers, heaters, and like devices that can facilitate operation of the vessel 160 and/or the demethanizer 162. In one implementation, the second peripheral component 166 may embody a boiler that couples with both the fourth vessel 160 and with the refrigeration unit 130 to condition temperature of the first refrigerant 134.

The fluid circuit 106 may couple the vessels 156, 158 with a flash drum 168 or like vessel. The flash drum 168 can couple with the storage facility 112 to provide the first product 108 for storage. The fluid circuit 106 may also include one or more throttling devices (e.g., a first throttling device 170, a second throttling device 172, and a third throttling device 174). Examples of the throttling 170, 172, 174 can include valves (e.g., Joule-Thompson valves) and/or devices that are similarly situated to throttle the flow of a fluid stream. These devices may be interposed between components in the fluid circuit 106 as necessary to achieve certain changes in fluid parameters (e.g., temperature, pressure, etc.). As noted below, the device may provide an expansion stage and a cooling stage, where applicable, to reduce pressure and/or temperature of the process stream 116.

Figure 3:
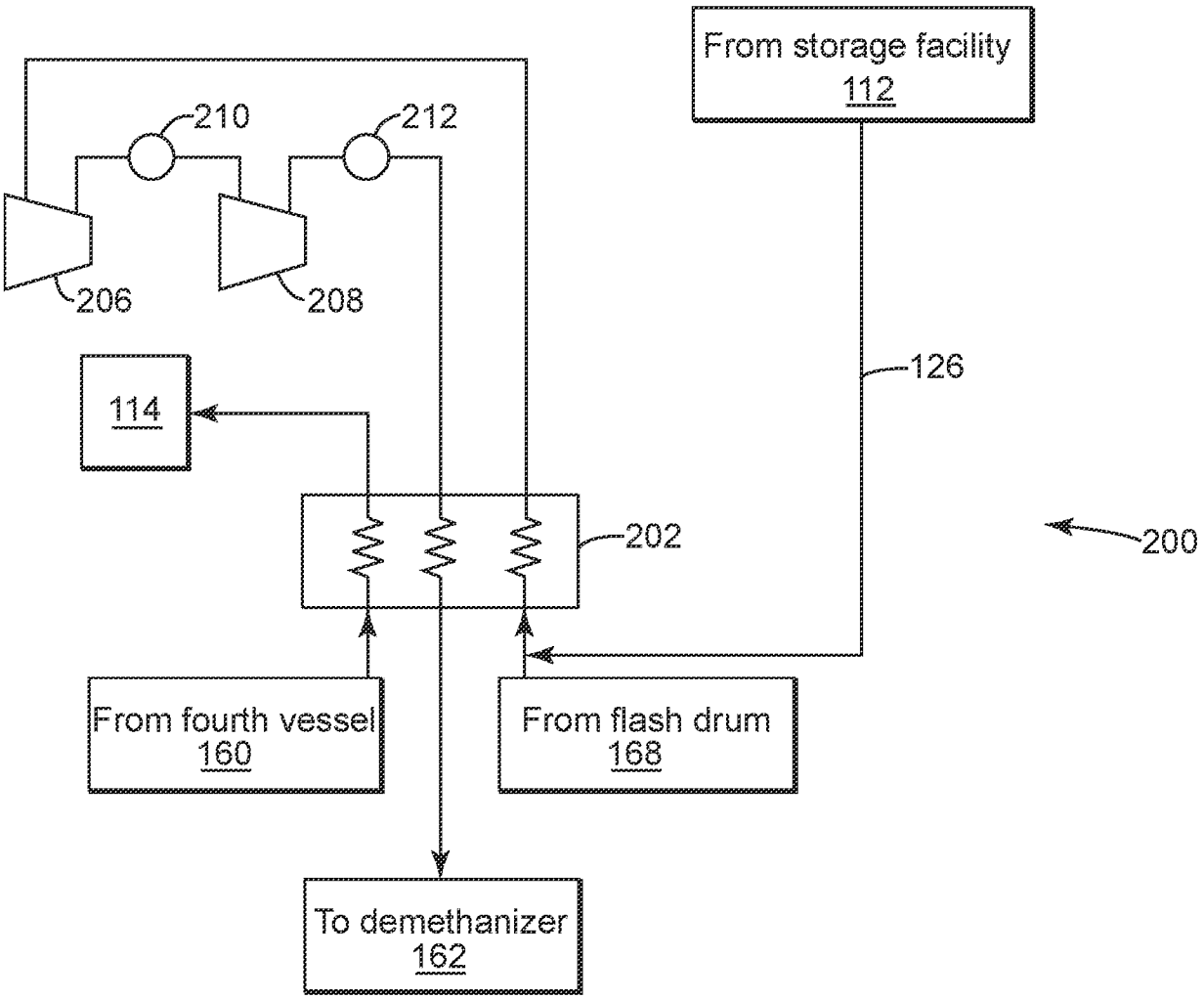
FIG. 3 depicts an example of a mixing unit for use in the fluid circuit of FIG. 2.

FIG. 3 illustrates an example of a mixing unit 200 for use in the processing system 100 of FIGS. 1 and 2. This example can couple with the storage facility 112, the separation unit 120, and the demethanizer unit 162. In one implementation, the mixing unit 200 may include a heat exchanger 202 that couples with a compression system 204. Examples of the heat exchanger 202 can include cross-flow devices of varying designs (e.g., spiral flow, counter-current flow, distributed flow, etc.), although other devices and designs that can effectively transfer thermal energy may also be desirable. The compression system 204 can have one or more compressors (e.g., a first compressor 206 and a second compressor 208) and one or more coolers (e.g., a first cooler 210 and a second cooler 212).

Referring back to FIG. 2, the fluid circuit 106 can direct the process stream 116 through the various components to generate the products 108, 110. The pre-cooling unit 118 can sub-cool the incoming feedstock 102 from a first temperature to a second temperature that is less than the first temperature. Incoming feedstock 102 may enter the device (at 176) at ambient temperature that prevails at the system 100 and/or surrounding facility. The coolers 138, 140, 142 can effectively reduce temperature of incoming feedstock 102 by at least about 120° F., with one example being configured to condition the process stream 116 to exit the cooling stages (at 178) at approximately −40° F. The fourth cooler 144 may provide a cooling stage to further reduce temperature of the liquefied ethane stream. This cooling stage can reduce temperature of the liquefied ethane stream by at least approximately 10° F., with one example of the fourth cooler 144 being configured so that the liquefied ethane stream exits this cooling stage (at 180) at approximately −50° F.

The fluid circuit 106 can direct the liquefied ethane stream to the first throttling device 170. In one implementation, this device can be configured to reduce pressure of the liquefied ethane stream 116 from a first pressure to a second pressure that is less than the first pressure. The first pressure may correspond with the super critical pressure for incoming feedstock 102. For liquid ethane, this super critical pressure may be approximately 800 psig or greater. The expansion stage can reduce pressure by at least approximately 700 psig. In one example, the first expansion unit 170 being configured so that the liquefied ethane stream exits this expansion stage (at 182) at approximately 100 psig. Expansion across the first throttling unit 170 may also provide a cooling stage to further lower the temperature of the process stream 108, e.g., to approximately −58° F.

The fluid circuit 106 can process the liquefied ethane stream at the reduced pressure and reduced temperature to obtain the first product 108. In use, the first product 108 will meet the methane concentration and other specifications for storage. Examples of these processes can form a top product and a bottom product at each of the vessels 154, 156, 158. The top product can be in vapor form. The bottom product can be in liquid form and/or mixed-phase form (e.g., a combination of liquid and vapor), often depending on temperature and/or pressure of the resulting fluid. In one implementation, the fluid circuit 106 can be configured to direct a mixed-phase bottom product from the first vessel 154 to the second vessel 156. The second throttling unit 172 can provide an expansion stage (and a cooling stage) to reduce pressure and temperature and produce a mixed-phase product between the vessels 154, 156. For example, the mixed-phase product can exit the expansion/cooling stage (at 184) at approximately 8 psig and approximately −120° F. prior to entry into the second vessel 156.

The fluid circuit 106 can be configured to combine the vapor top products from the vessels 154, 156 upstream of the fifth cooler 146. In use, the fifth cooler 146 can provide a cooling stage so that the combined mixed phase product exits the cooling stage (at 186) at approximately −138° F. prior to entry into the third vessel 156. The fluid circuit 106 can also combine the bottom product from the vessels 156, 158, either in liquid form and/or mixed-phase form, as the process stream 116. The sixth cooler 148 can provide a cooling stage so that the combined mixed phase bottom product exits the cooling stage (at 188) at approximately −132° F. and approximately 2 psig.

The fluid circuit 106 can direct the combined liquid bottom product to the flash drum 168 at a reduced temperature and pressure. The flash drum 168 can form a liquid product and a vapor product. The fluid circuit 106 can direct the liquid product to the storage facility 112 or elsewhere as desired.

As best shown in FIG. 3, the fluid circuit 106 can direct the vapor product from the flash drum 168 through the heat exchanger 202. Downstream of the heat exchanger 202, the fluid circuit 106 can combine the vapor product from the flash drum 168 with incoming return stream 126, often the boil-off vapor that forms at the storage facility 112. The compressors 206, 208 and the coolers 210, 212 can condition temperature and pressure of the combined vapor stream upstream of the heat exchanger 202. The conditioned vapor flows onto the demethanizer column 162 via the heat exchanger 202.

Referring back to FIG. 2, processes at the demethanizer column 162 can form a top product and a bottom product, typically in vapor phase and liquid (or mixed) phase, respectively. In one implementation, the bottom product exits the demethanizer column 162 to the third throttling device 174. The third throttling device 174 can provide an expansion stage to reduce pressure (and temperature) of this bottom product between the second vessel 156 and the demethanizer column 162. For example, the bottom product can enter the expansion stage (at 190) at approximately 470 psig and approximately 57° F. and exit the expansion stage (at 194) at approximately 8 psig and approximately −114° F. prior to entry into the second vessel 156.

The fluid circuit 106 can be configured to recycle the top product from the demethanizer column 162. The seventh cooler 150 may operate as an overhead condenser for the demethanizer column 162. This overhead condenser can provide a cooling stage so that the top product exits the cooling stage (at 196). The cooled top product enters the fourth vessel 160, operating here as a reflux drum. In turn, the fourth vessel 160 can form a top product and a bottom product. The pump 164 can pump the liquid bottom product from the fourth vessel 160 back to the demethanizer column 162. The top product can be predominantly methane vapor that exits the system 100 as the second product 110 via the heat exchanger 202 (FIG. 3).

Figure 4:
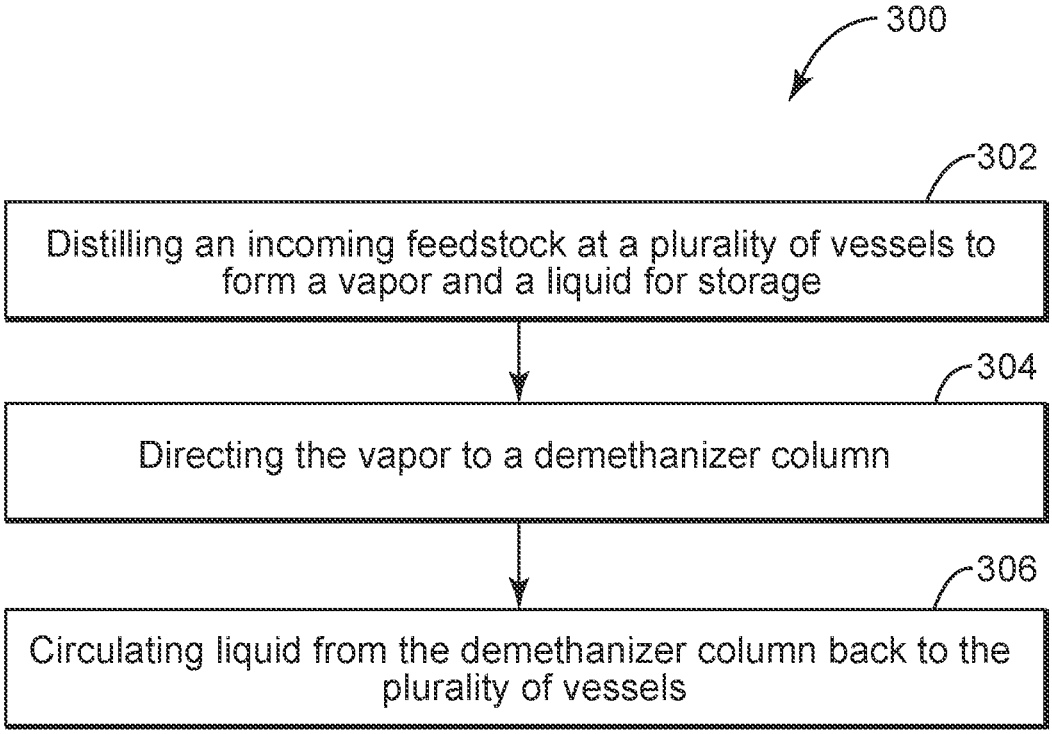
FIG. 4 depicts a flow diagram of an exemplary embodiment of a process to prepare incoming hydrocarbon feedstock for storage.
Figure 5:
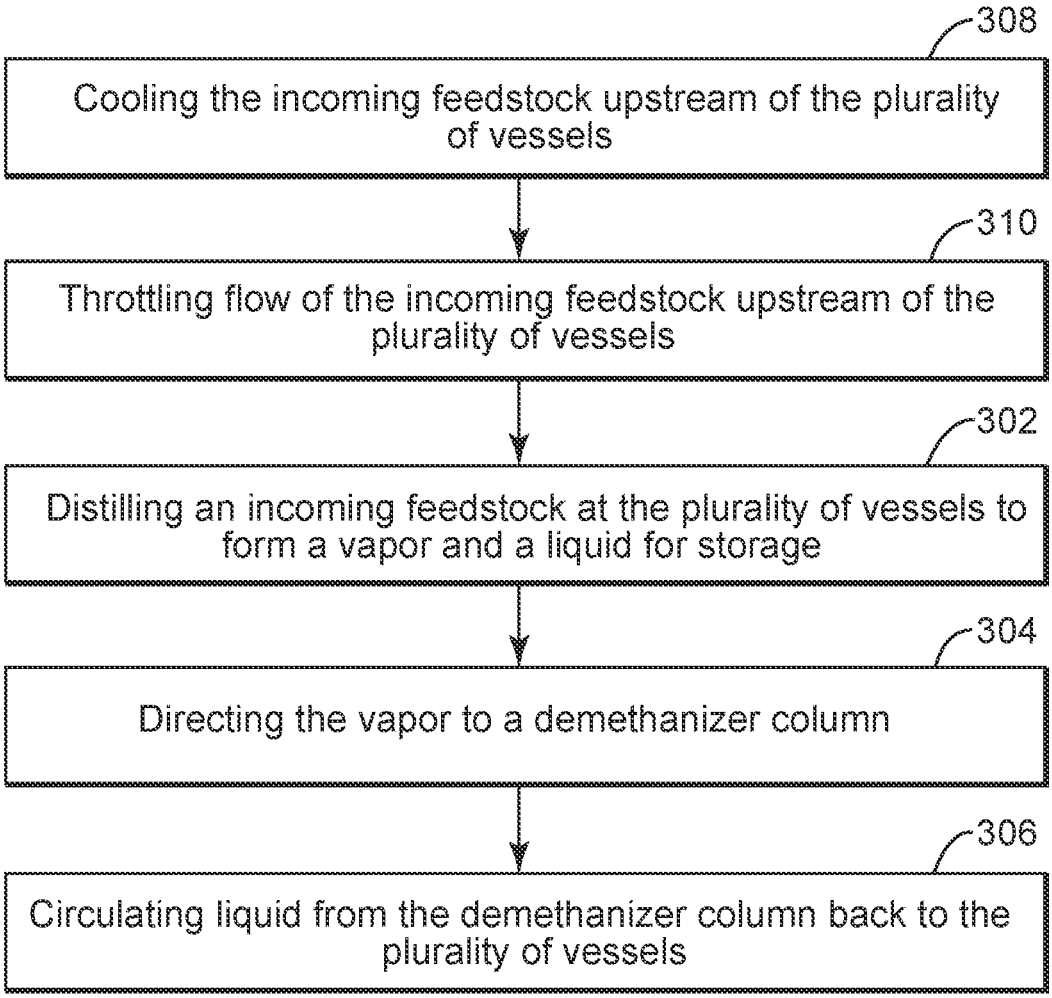
FIG. 5 depicts a flow diagram of an example of the process of FIG. 4.
Figure 6:
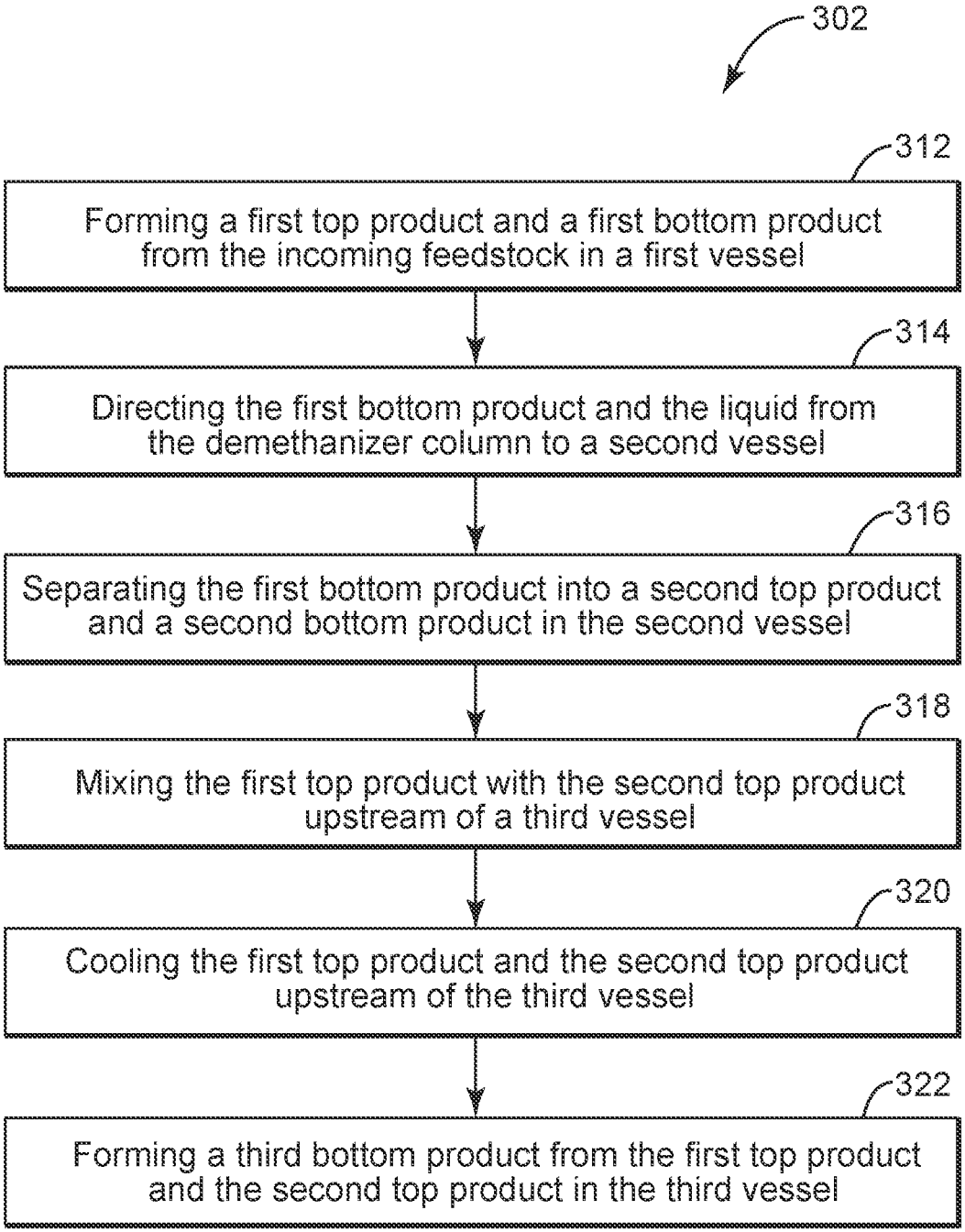
FIG. 6 depicts a flow diagram of an example of the process of FIGS. 4 and 5.

FIGS. 4, 5, and 6 depict flow diagrams of an exemplary embodiment of a process 300 to prepare incoming liquid ethane (and, generally, feedstock 102) for storage. In FIG. 4, the process 300 can include, at stage 302, distilling an incoming feedstock at a plurality of vessels to form a vapor and a liquid for storage. The process 300 can also include, at stage 304, directing the vapor to a demethanizer column and, at stage 306, circulating liquid from the demethanizer back to the plurality of vessels. As shown in FIG. 5, the process 300 can also include, at stage 308, cooling the incoming feedstock upstream of the plurality of vessels and, at stage 310, throttling flow of the incoming feedstock upstream of the plurality of vessels.

Referring also to FIG. 6, stage 302 in the process 300 can incorporate various stages to distill the incoming feedstock, as desired. In one implementation, these stages may include, at stage 312, forming a first top product and a first bottom product from the incoming feedstock in a first vessel. The stages may also include, at stage 314, directing the first bottom product and the liquid from the demethanizer column to a second vessel and, at stage 316, separating the first bottom product into a second top product and a second bottom product in the second vessel. The stages may further include, at stage 318, mixing the first top product with the second top product upstream of a third vessel, at stage 320, cooling the first top product and the second top product upstream of the third vessel, and, at stage 322, forming a third bottom product from the first top product and the second top product in the third vessel.

As used herein, an element or function recited in the singular and proceeded with the word "a" or "an" should be understood as not excluding plural said elements or functions, unless such exclusion is explicitly recited. Furthermore, references to "one embodiment" should not be interpreted as excluding the existence of additional embodiments that also incorporate the recited features.

This written description uses examples to disclose the embodiments, including the best mode, and also to enable any person skilled in the art to practice the embodiments, including making and using any devices or systems and performing any incorporated methods. The patentable scope of the embodiments is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gas processing system, comprising:

a fluid circuit configured to process an incoming feedstock comprising predominantly ethane liquid into liquid ethane, the fluid circuit comprising:

a first expansion valve;

a distilling unit comprising a first vessel, a second vessel, and a third vessel, the distilling unit further comprising a second expansion valve coupled with the first vessel and the second vessel and a first cooler coupled with the first vessel, the second vessel, and the third vessel;

a flash drum; and a demethanizer unit comprising a demethanizer column, a second cooler coupled with the demethanizer column, a reflux drum coupled with the second cooler and a pump coupled with the reflux drum and the demethanizer column, wherein the fluid circuit is configured to direct the incoming feedstock through the first expansion valve to the first vessel, to direct liquid from the first vessel through the second expansion valve to the second vessel, to direct vapor from the first vessel and the second vessel through the first cooler to the third vessel, and to direct liquid from the second vessel and the third vessel to the flash drum, wherein the fluid circuit is configured to direct vapor from the flash drum to the demethanizer column, wherein the fluid circuit is configured to direct vapor from the demethanizer column to the second cooler, which cools the vapor, to direct the cooled vapor from the second cooler to the reflux drum, to direct liquid from the reflux drum to the pump, and to direct liquid from the pump to the demethanizer column, and wherein the fluid circuit is configured to reduce pressure of liquid from the demethanizer column from a first pressure to a second pressure, and direct the liquid, at the second pressure, from the demethanizer column directly to the second vessel.

2. The gas processing system of claim 1, wherein the fluid circuit comprises:

a mixing unit comprising a compressor and a heat exchanger that are arranged to form a mixture of the vapor that exits the flash drum with boil-off gas from a storage facility, wherein the fluid circuit is configured to direct the mixture to the demethanizer column.

3. The gas processing system of claim 1, wherein the fluid circuit comprises:

a second valve disposed downstream of the demethanizer column and upstream of the second vessel to reduce pressure of the liquid that exits the demethanizer column.

* * * * *